US012546554B2

(12) United States Patent
Teetzel et al.

(10) Patent No.: US 12,546,554 B2
(45) Date of Patent: Feb. 10, 2026

(54) POWER AND DATA INTERFACE FOR WEAPON ACCESSORY MOUNTING RAIL

(71) Applicant: WILCOX INDUSTRIES CORP., Newington, NH (US)

(72) Inventors: James W. Teetzel, Portsmouth, NH (US); Elliott S. Turner, Newmarket, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 18/755,052

(22) Filed: Jun. 26, 2024

(65) Prior Publication Data

US 2025/0003712 A1 Jan. 2, 2025

Related U.S. Application Data

(60) Provisional application No. 63/523,767, filed on Jun. 28, 2023.

(51) Int. Cl.

| | |
|---|---|
| ***F41A 35/00*** | (2006.01) |
| ***F41C 27/00*** | (2006.01) |
| ***F41G 11/00*** | (2006.01) |

(52) U.S. Cl.

CPC ..... *F41A 35/00* (2013.01); *F41C 27/00* (2013.01); *F41G 11/003* (2013.01)

(58) Field of Classification Search

CPC ..... F41G 11/003; F41A 35/00; F41C 27/00
See application file for complete search history.

(56) References Cited

U.S. PATENT DOCUMENTS

| | | | | |
|---|---|---|---|---|
| 7,975,419 | B2 * | 7/2011 | Darian | F41C 27/00 42/84 |
| 8,091,265 | B1 * | 1/2012 | Teetzel | F41C 23/16 42/71.01 |

(Continued)

FOREIGN PATENT DOCUMENTS

| | | | | |
|---|---|---|---|---|
| NO | 329709 | B1 * | 12/2010 | F41G 11/003 |
| WO | WO-2010107324 | A1 * | 9/2010 | F41G 11/003 |
| WO | WO-2011079233 | A2 * | 6/2011 | F41G 11/003 |

OTHER PUBLICATIONS

Extended European Search Report in Application No. 24184649.2 dated Nov. 27, 2024, 8 pages.

(Continued)

*Primary Examiner* — Jonathan C Weber
(74) *Attorney, Agent, or Firm* — McLane Middleton, Professional Association

(57) ABSTRACT

A system and method for connecting a weapon-mounted accessory to a computer comprises a first data and power port configured to provide data and power transmission between the computer and the weapon-mounted accessory. The first data and power port is configured to detachably couple to a slot in a slot rail weapon interface. In a further aspect, one or more additional data and power ports are capable of providing data and power transmission between the computer and one or more additional weapon-mounted accessories. Each of the one or more additional data and power ports is configured to detachably couple to a slot in a slot rail weapon interface. The first data and power port and the one or more additional data and power ports are configured to be operably connected to each other to form a serial chain in a custom configuration of data and power ports.

13 Claims, 18 Drawing Sheets

(56) References Cited

U.S. PATENT DOCUMENTS 8,104,211 B2 * 1/2012 Darian ..... F41C 27/00 42/84
8,146,282 B2 * 4/2012 Cabahug ..... F41C 23/22 42/72
8,225,544 B2 * 7/2012 Darian ..... F41C 23/22 42/84
8,297,173 B1 10/2012 Teetzel et al.
8,397,418 B2 * 3/2013 Cabahug ..... F41C 27/00 42/72
8,443,539 B2 * 5/2013 Cabahug ..... F41G 11/003 42/71.01
8,448,368 B2 * 5/2013 Cabahug ..... F41G 11/003 42/72
8,516,731 B2 * 8/2013 Cabahug ..... F41G 11/003 42/72
11,067,367 B2 7/2021 Delgado Acarreta et al.
2010/0031552 A1 * 2/2010 Houde-Walter ..... F41C 23/16 42/72
2010/0180485 A1 * 7/2010 Cabahug ..... F41C 27/00 42/90
2010/0192443 A1 * 8/2010 Cabahug ..... F41C 23/16 42/71.01
2010/0192444 A1 * 8/2010 Cabahug ..... F41G 11/003 42/71.01
2010/0192446 A1 * 8/2010 Darian ..... F41G 11/003 320/108
2010/0192448 A1 * 8/2010 Darian ..... F41G 11/003 42/84
2011/0010979 A1 * 1/2011 Houde-Walter ..... F41G 11/003 42/84
2011/0061284 A1 * 3/2011 Cabahug ..... F41C 27/00 42/84
2011/0131858 A1 * 6/2011 Darian ..... F41G 11/003 42/90
2011/0283585 A1 * 11/2011 Cabahug ..... F41G 11/003 42/73
2012/0131837 A1 * 5/2012 Cabahug ..... F41C 27/00 42/84
2012/0144716 A1 * 6/2012 Cabahug ..... F41C 23/22 42/84
2012/0180364 A1 * 7/2012 Berntsen ..... F41C 23/16 42/90
2013/0185978 A1 * 7/2013 Dodd ..... F41G 11/003 42/84
2014/0047754 A1 * 2/2014 Compton ..... F41G 11/00 42/84
2014/0345181 A1 11/2014 Teetzel et al.
2015/0020427 A1 * 1/2015 Compton ..... F41A 35/00 42/71.01
2015/0041538 A1 2/2015 Teetzel et al.
2016/0211095 A1 7/2016 Zimmer
2016/0327371 A1 11/2016 Teetzel et al.
2017/0205202 A1 7/2017 Teetzel et al.
2018/0328698 A1 * 11/2018 Miller ..... F41C 23/22
2019/0049221 A1 2/2019 Zimmer
2019/0249958 A1 8/2019 Teetzel et al.
2019/0376755 A1 12/2019 Teetzel et al.
2021/0391892 A1 * 12/2021 Ellena ..... F41C 27/00
2023/0189428 A1 * 6/2023 Aguilar ..... F41C 23/16 42/71.01
2024/0133648 A1 4/2024 Teetzel et al.
2024/0255257 A1 8/2024 Teetzel et al.
2024/0274954 A1 8/2024 Teetzel et al.

OTHER PUBLICATIONS

Extended European Search Report in Application No. 24199693.3 dated Jan. 13, 2025, 9 pages.

* cited by examiner

POWER AND DATA INTERFACE FOR WEAPON ACCESSORY MOUNTING RAIL

CROSS REFERENCE TO RELATED APPLICATION

This application claims the priority benefit of U.S. provisional application No. 63/523,767 filed Jun. 28, 2023. The aforementioned application is incorporated here by reference in its entirety.

BACKGROUND

The present invention relates to a weapon mounting system, and more particularly to a system and method for providing electrical and data connections on a weapon, e.g., firearm, mount.

Advantages and benefits of the present invention will become apparent to those of ordinary skill in the art upon reading and understanding the following detailed description of the preferred embodiments.

SUMMARY

In one aspect, a system for connecting a weapon-mounted accessory to a computer comprises a first data and power port configured to operably connect to the computer, the first data and power port being capable of providing data and power transmission between the computer and the weapon-mounted accessory. The first data and power port is configured to detachably couple to a slot in a slot rail weapon interface.

In a more limited aspect, the first data and power port includes a housing having a peripheral flange disposed on an exterior facing side of the first data and power port and at least one rotating tab which cooperates with the peripheral flange to define a channel therebetween. The at least one rotating tab rotatable between a first position wherein the at least one rotating tab extends generally perpendicular to the longitudinal axis of the slot and is configured to permit insertion and removal of the first data and power port with respect to the slot and a second position wherein the at least one rotating tab extends generally parallel to the longitudinal axis of the slot and is configured to secure a rim of the slot within the channel to retain the first data and power port within the slot.

In another more limited aspect, the housing further includes an integral latch for detachably engaging a complementary catch latch disposed on the weapon-mounted accessory.

In another more limited aspect, the first data and power port includes a housing having a peripheral flange disposed on an exterior facing side of the first data and power port and a pair of axially spaced apart rotating tabs, each of the rotating tabs cooperating with the peripheral flange to define a channel therebetween. Each of the rotating tabs rotatable between a first position wherein the rotating tabs extend generally perpendicular to the longitudinal axis of the slot and are configured to permit insertion and removal of the first data and power port with respect to the slot and a second position wherein the tabs extend generally parallel to the longitudinal axis of the slot and are configured to secure a rim of the slot within the channel to retain the first data and power port within the slot.

In another more limited aspect, the system further comprises one or more additional data and power ports, each additional data and power port being capable of providing data and power transmission between the computer and one or more additional weapon-mounted accessories. Each of the one or more additional data and power ports is configured to detachably couple to a slot in a slot rail weapon interface. The first data and power port and the one or more additional data and power ports are configured to be operably connected to each other to form a serial chain in a custom configuration of data and power ports. The custom configuration of data and power ports enables simultaneous data and power transmission between the computer, the accessory connected to the first data and power port, and each of the one or more additional accessories connected to the one or more additional data and power ports.

In another more limited aspect, the system is provided in combination with the computer.

In another more limited aspect, the computer is configured to detachably couple to a slot in the slot rail weapon interface.

In another more limited aspect, the computer includes a battery pack interface for detachably and operatively coupling a battery pack to the computer, wherein the computer is configured to electrically couple the battery pack to the first data and power port when the battery pack coupled to the battery pack interface.

In another more limited aspect, the system is provided in combination with the battery pack.

In another more limited aspect, the battery pack interface is a Small Tactical Universal Battery (STUB) interface.

In another more limited aspect, the system further comprises a weapon handguard configured to surround a barrel of a weapon, wherein the slot rail weapon interface is disposed on the handguard.

In another more limited aspect, the system further comprises a cable for electrically coupling the first data and power port to the computer, wherein at least a portion of the cable is configured to pass within an interior space defined by the handguard.

In another more limited aspect, the first data and power port includes a housing configured to be positioned over the slot in the slot rail weapon interface and a first retention clip coupled to the housing and configured to detachably engage with a first like slot adjacent the slot. A second retention clip is coupled to the housing and is configured to detachably engage with a second like slot which is adjacent the slot and opposite the first like adjacent slot. An electrical power and data cable is configured to pass through the slot.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention, which may be embodied in various forms. Therefore, specific structural and functional details disclosed herein are not to be interpreted as limiting but merely as a basis for the claims and as a representative basis for teaching one skilled in the art to variously employ the present inventive concept in virtually any appropriately detailed structure. Further, the terms and phrases used herein are not intended to be limiting but rather to provide an understandable description of the present development. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiment(s) of the present invention, and are not intended to limit the structure thereof to any particular position or orientation.

All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

Figure 1:
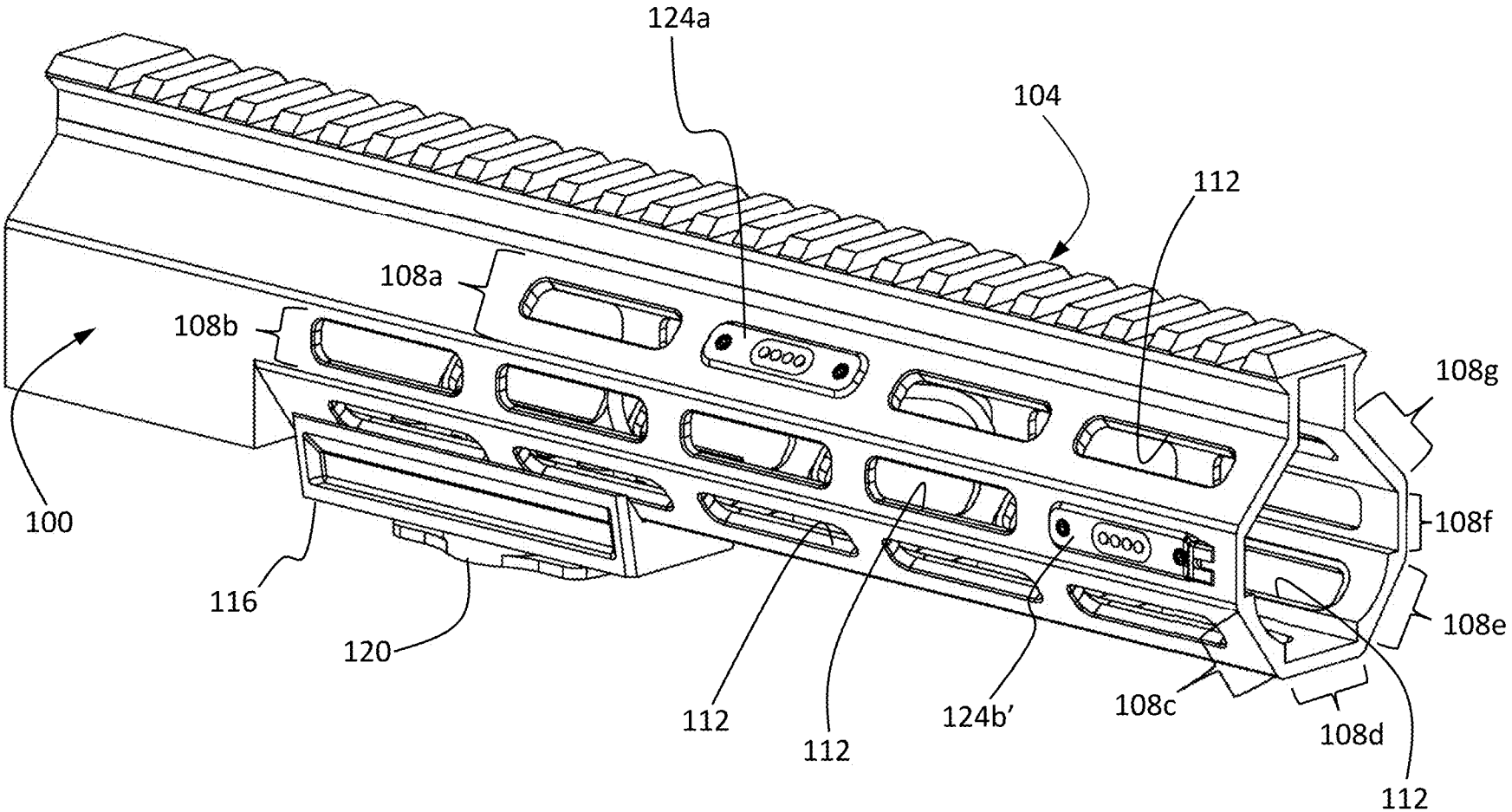
FIG. 1 is an isometric view of a handguard system in accordance with an exemplary embodiment.

Referring now to the drawings, FIG. 1 shows an exemplary handguard 100. In the illustrated embodiment, the handguard 100 includes an upper Picatinny rail interface portion 104 and one or more slot rail portions 108*a*-108*g* for mounting one or more accessories to the weapon for increased functionality of the weapon, such as scopes, sights, lasers, rangefinders, and others. The slot rail interface portions 108*a*-108*g* may comprise M-LOK™ (Magpul Industries Corp., Austin, TX) compatible mounting interface or similar system.

Each slot rail portion includes a series of apertures or slots 112 which are configured to receive an M-LOK or similar accessory or fastener. In the illustrated embodiment, a computer or control module 116 is attached to the section 108*d* via the slots 112 thereon. The control module 116 includes a bayonet style battery interface 120 for connecting a power supply (not shown). The control module 116 includes a processor and wireless interface for management of data communications with one or more power and data ports or inserts 124*a*, 124*b*' as will be described in greater detail below. The position of the arrangement of the control module 116 and the power and data ports can be selected by the user to form a custom configuration of data and power ports, e.g., in accordance with the functionality desired by the user.

Figure 2:
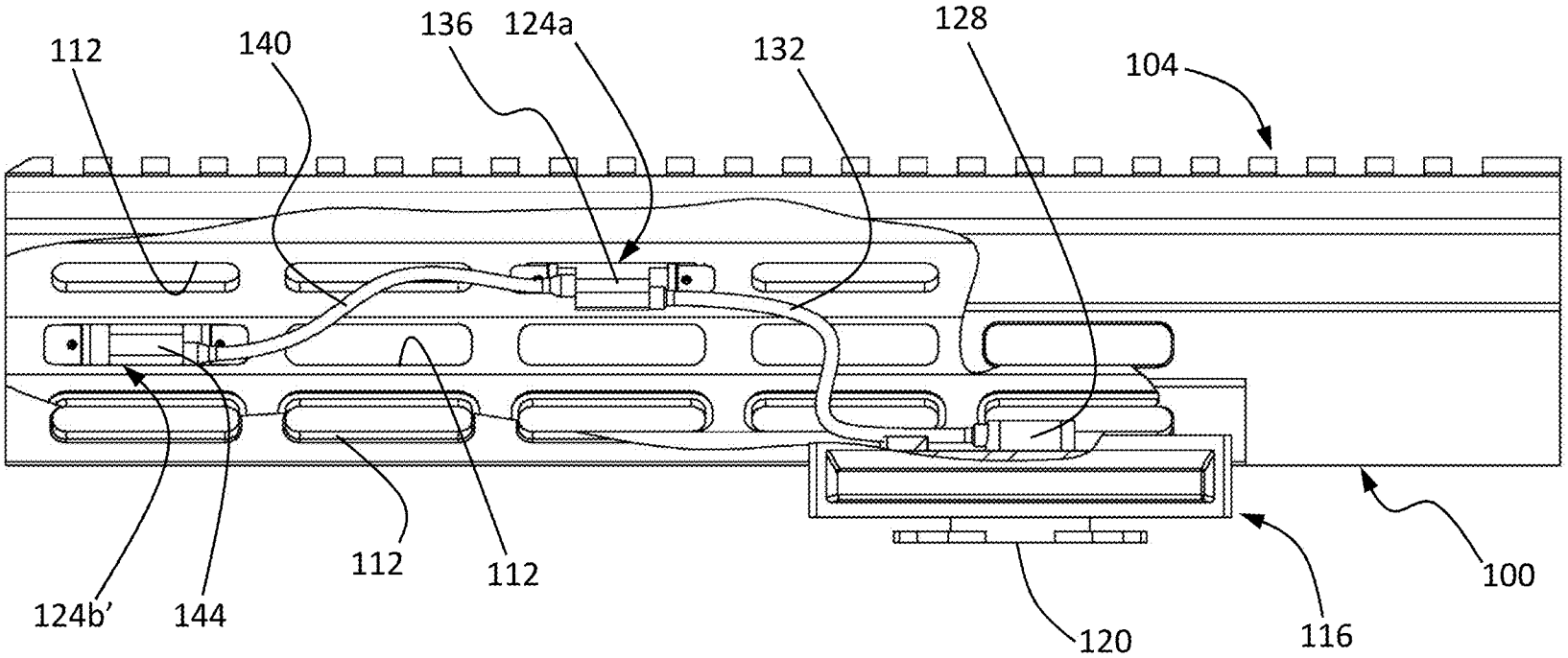
FIG. 2 is a fragmentary side view of the handguard system appearing in FIG. 1.
Figure 3:
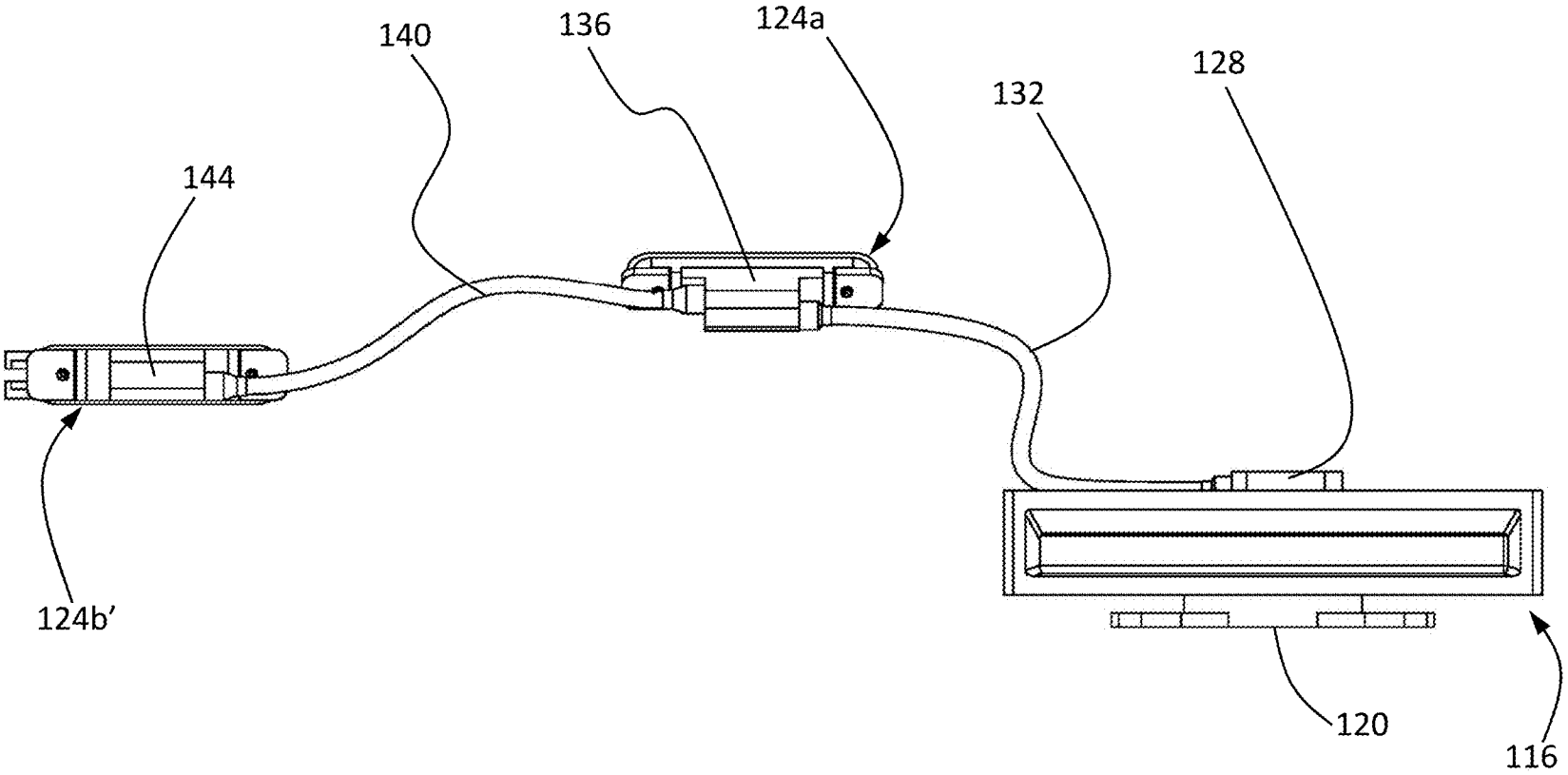
FIG. 3 is a side view of the control module and connector inserts appearing in FIG. 2, with the hand guard removed for ease of exposition.

Referring now to FIGS. 2 and 3, and with continued reference to FIG. 1, the control module 116 is secured via to a slot 112 and includes a connector element 128 which extends through the slot 112 into the interior of the handguard 100. The connector element 128 is coupled to a cable 132. The cable 132 in turn is coupled to a connector element 136 on the first insert 124*a*. The connector element 136, in turn, is coupled to a cable 140. The cable 140, in turn, is coupled to a connector element 144 on the second insert 124*b*'.

Figure 4:
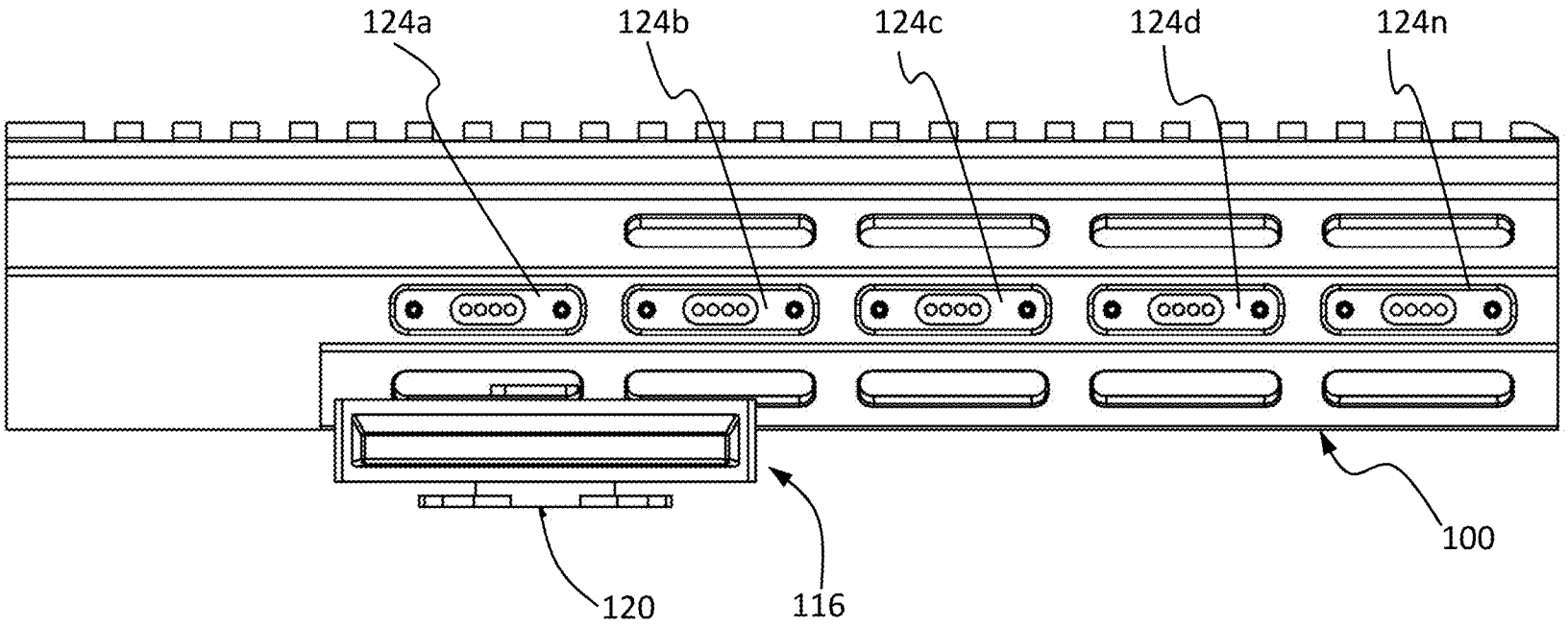
FIG. 4 is a side view of the handguard appearing in FIG. 1 with an alternate configuration of inserts.
Figure 5:
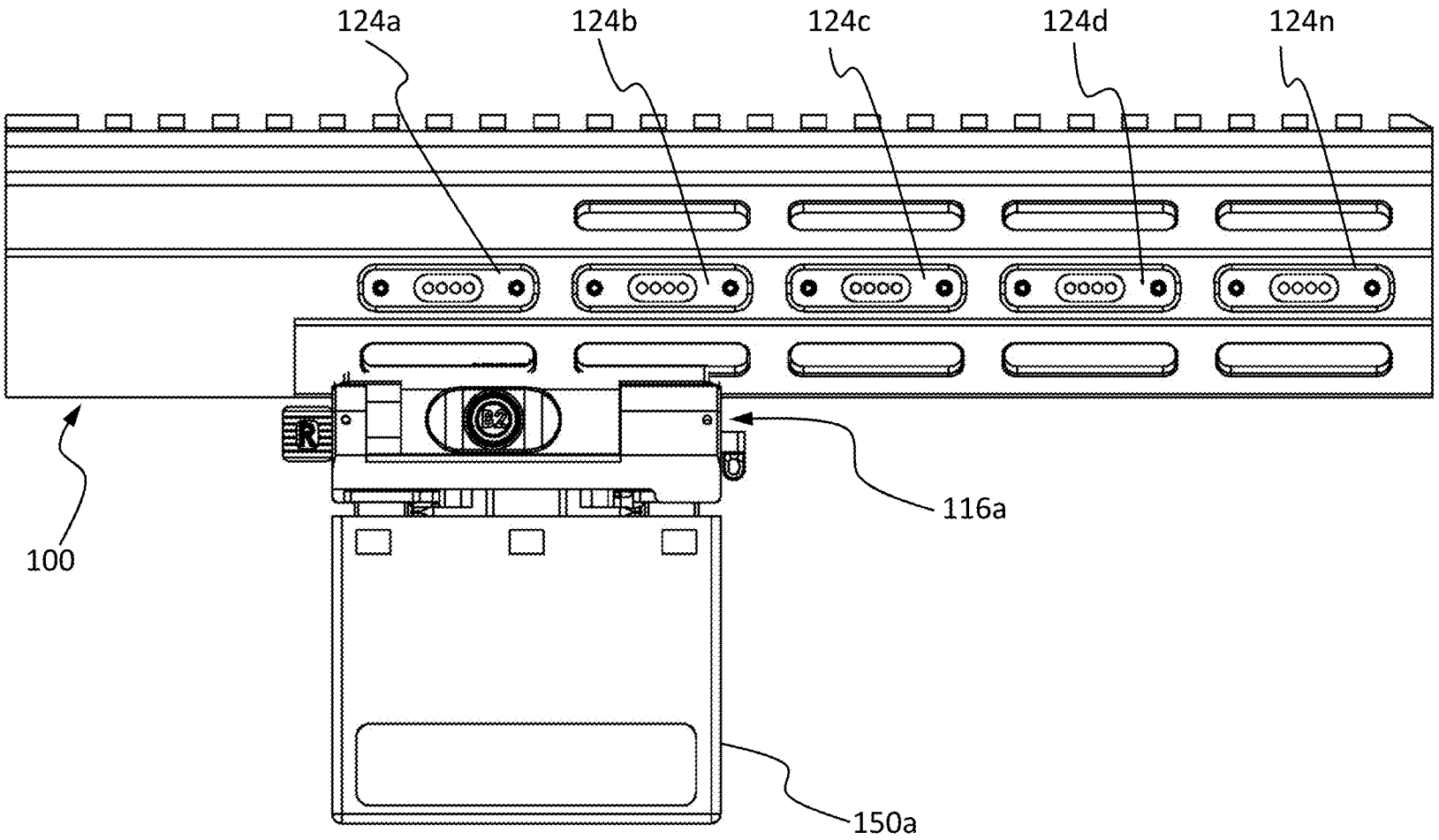
FIG. 5 is a side view of the handguard system appearing in FIG. 4 with a first embodiment battery pack attached.
Figure 6:
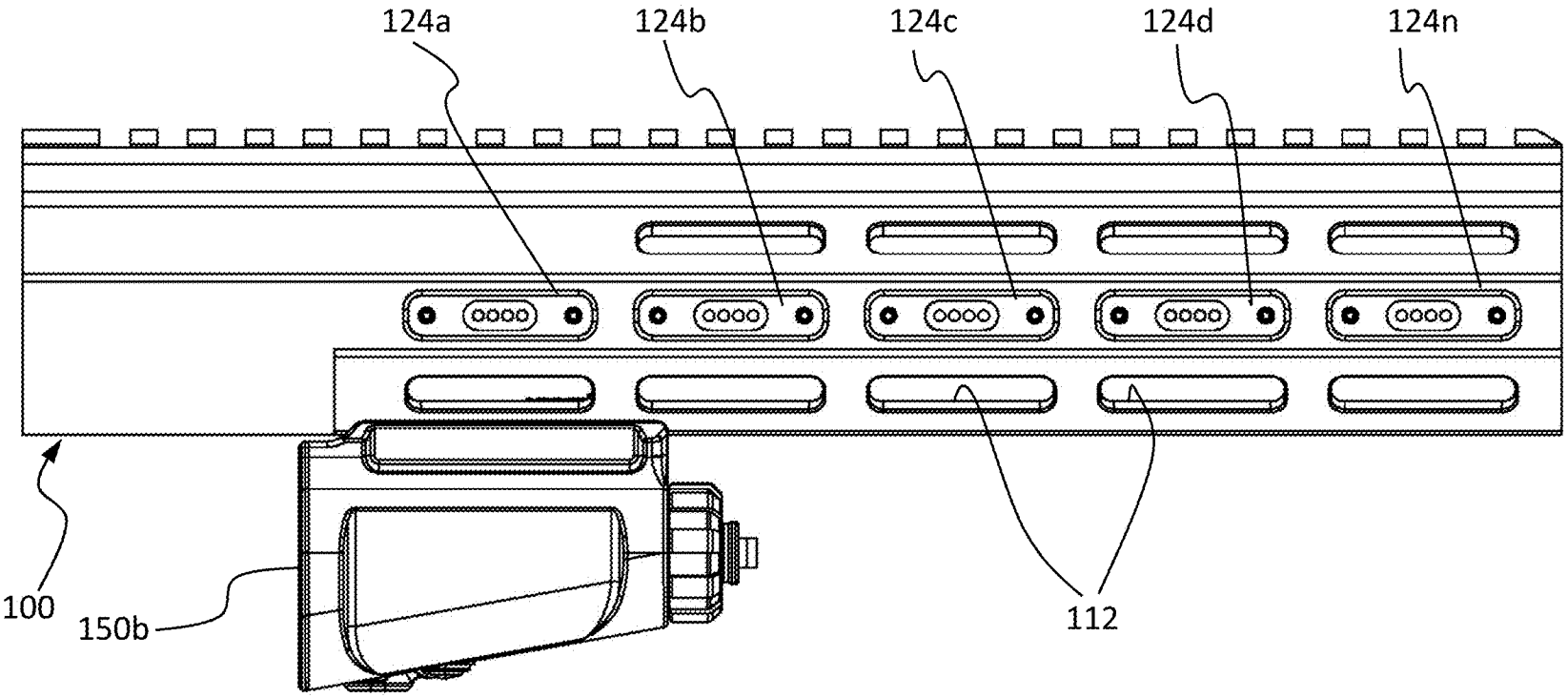
FIG. 6 is a side view of the handguard system appearing in FIG. 4 with a second embodiment battery pack attached.

In this manner, the inserts 124*a* and 124*b*' are daisy-chained, thereby allowing simultaneous power and data connections to the controller 116. As illustrated in FIGS. 4-6, any number of inserts 124*a*, 124*b*, 124*c*, 124*d*, up to n inserts 124*n*, may be utilized, where n is any integer, limited only by the number of available slots 112. Each insert 124*a*-124*n* acts as an input and output, enabling the connection of multiple devices in a linear fashion. This daisy-chaining capability eliminates the need for complex wiring configurations or additional hubs, streamlining the setup process and providing an efficient solution for managing multiple accessory devices. In operation, the user identifies which slots 112 on the handguard 100 where they will mount their accessories based on their desired location. The chosen slots 112 have the inserts 124*a*-124*n* installed into them as will be described below. The inserts are connected to each other via daisy chain and then to the control module 116.

FIG. 5 illustrates a further embodiment, wherein a Small Tactical Universal Battery (STUB) rechargeable battery pack 150*a* is attached to the handguard 100 via an alternative embodiment controller 116*a*. FIG. 6 illustrates yet another embodiment, wherein a FUSION™ CR 123a battery pack 150*b* (Wilcox Industries Corp., Newington, NH) is attached to the handguard 100 via one of the slots 112.

Referring now to FIGS. 7, 9 and 13-15, there are several views of an insert 124*a*. The insert 124*a* includes a housing 152 having an upper peripheral flange 156. In embodiments, the peripheral flange has a beveled edge 158 which provides smoother profile, thereby reducing snagging potential and improving ergonomics and comfort when handling and manipulating the weapon. The housing 152 is attached to the connector element 128 which includes cable connectors 130 for cable connection to the controller 120 and/or an adjacent insert in the chain. Electrical contacts 160*a*-160*b* are potted within an electrical insulator block 160 and electrically coupled to the connectors 130 for transmitting power and data signals.

In embodiments, the contact 160*a* is a ground (GND) pad used as a reference point for electrical potential and common return path for the circuit. In operation, the contact 160*a* is electrically coupled to the ground (e.g., negative) terminal of the power supply 150*a*, 150*b*, etc. In embodiments, the contact pads 160*b* and 160*c* are coupled to data plus (D+) and data minus (D−) data lines, respectively, which carry the positive and negative signals respectively, for transmitting data between devices in accordance with a digital communication protocol. The digital communication protocol and corresponding connectors may be adapted to accommodate any communication protocol that is suitable for low speed data communication. This includes, without limitation, various protocols such as Universal Serial Bus (USB), General Purpose Input/Output (GPIO), Serial Peripheral Interface (SPI), Inter-Integrated Circuit (I2C), Universal Asynchronous Receiver-Transmitter (UART), and Apple Lightening. In embodiments, the contact 160*d* is a voltage common collector (VCC) contact which is electrically coupled to the power supply voltage (e.g., positive) terminal of the power supply 150*a*, 150*b*, etc.

Figure 7:
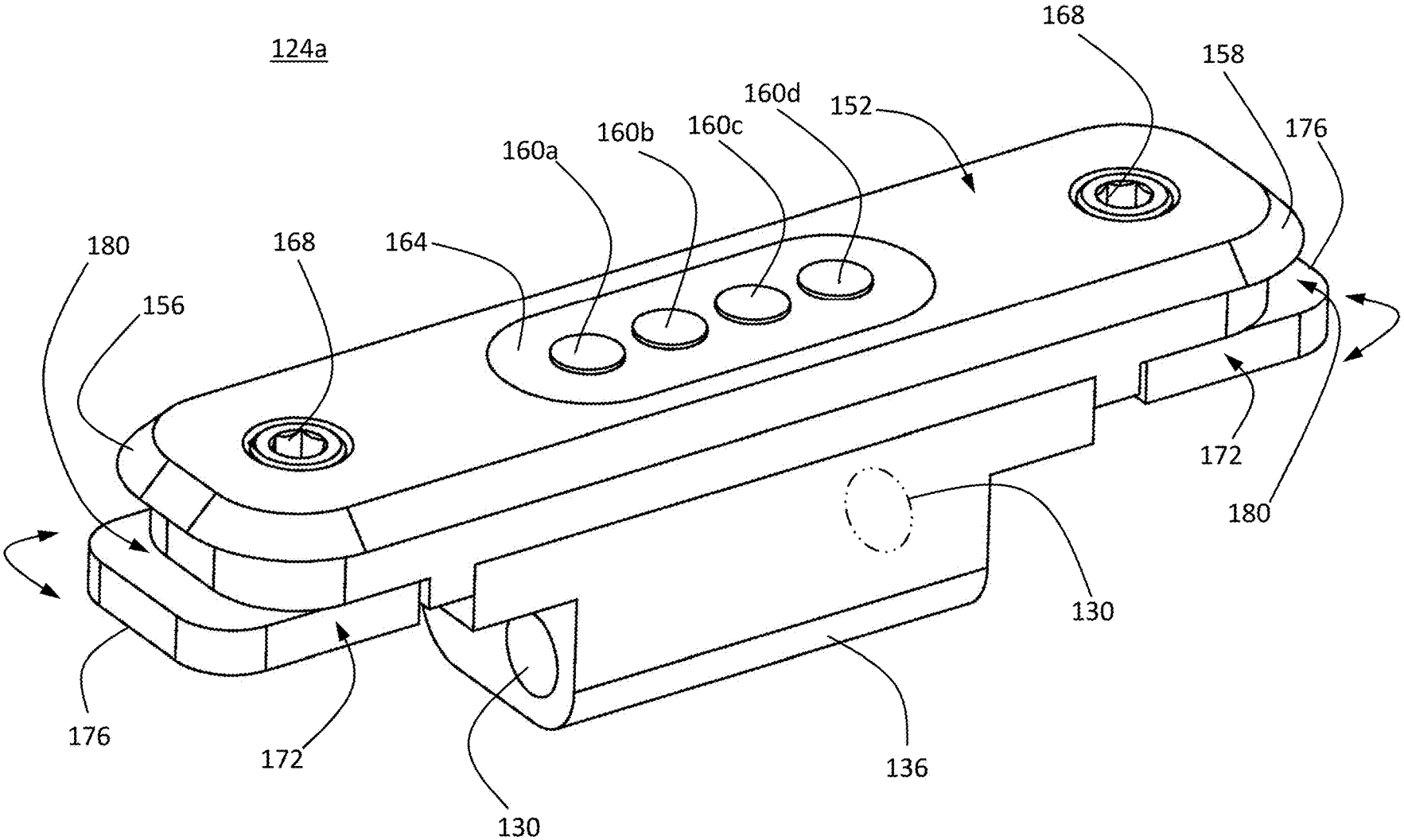
FIG. 7 is an enlarged isometric view of an insert according to a first exemplary embodiment.
Figure 9:
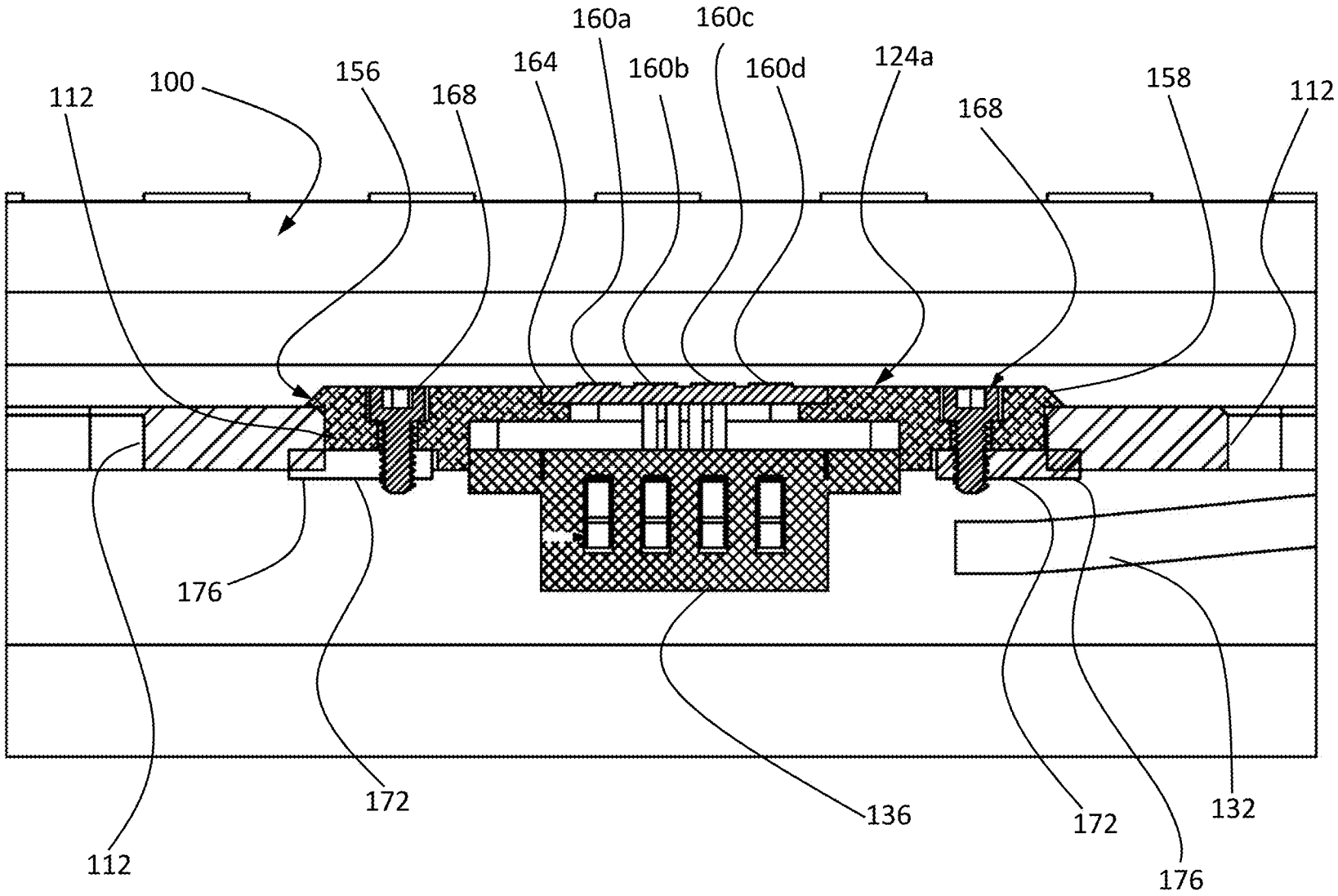
FIG. 9 is a side cross sectional view of an insert attached to a slot of a slot rail system.

Threaded fasteners 168 engage rotatable retention clips 172 which are rotatable in the direction of the arrows appearing in FIG. 7. The retention clips 172 include an extending tab portion 176 which cooperate with the peripheral flange 156 to define a channel 180 at each end. Rotation of the fastener 168 allows for selectively tightening/clamping and loosening/unclamping the insert within a slot 112, as best seen in FIG. 9. The corners of the retention clips 172 can be selectively radiused or rounded to permit the clips 172 to rotate when the threaded fasteners 168 are rotated and squared to act as stops to prevent rotation of the clips 172 when the threaded fasteners 168 are rotated, i.e., depending on the direction of rotation and current position of the clips 172.

In operation, to secure the insert 124*a* within a slot, the fasteners 168 are rotated so that the tabs 176 extend in a direction perpendicular to the longitudinal axis of the slot, such that the insert 124*a* can pass through the slot opening. Once inserted, the tabs 176 are rotated 90 degrees via the fasteners 168 to become parallel to the longitudinal axis of the slot, thereby extending beyond the opposing ends of the slot to securely retain the insert 124*a* in place. In this manner, the rim of the slot is captured within the channel 180 between the tab 176 and the peripheral flange 156. To remove the insert 124*a* from the slot, the process is reversed.

Figure 8:
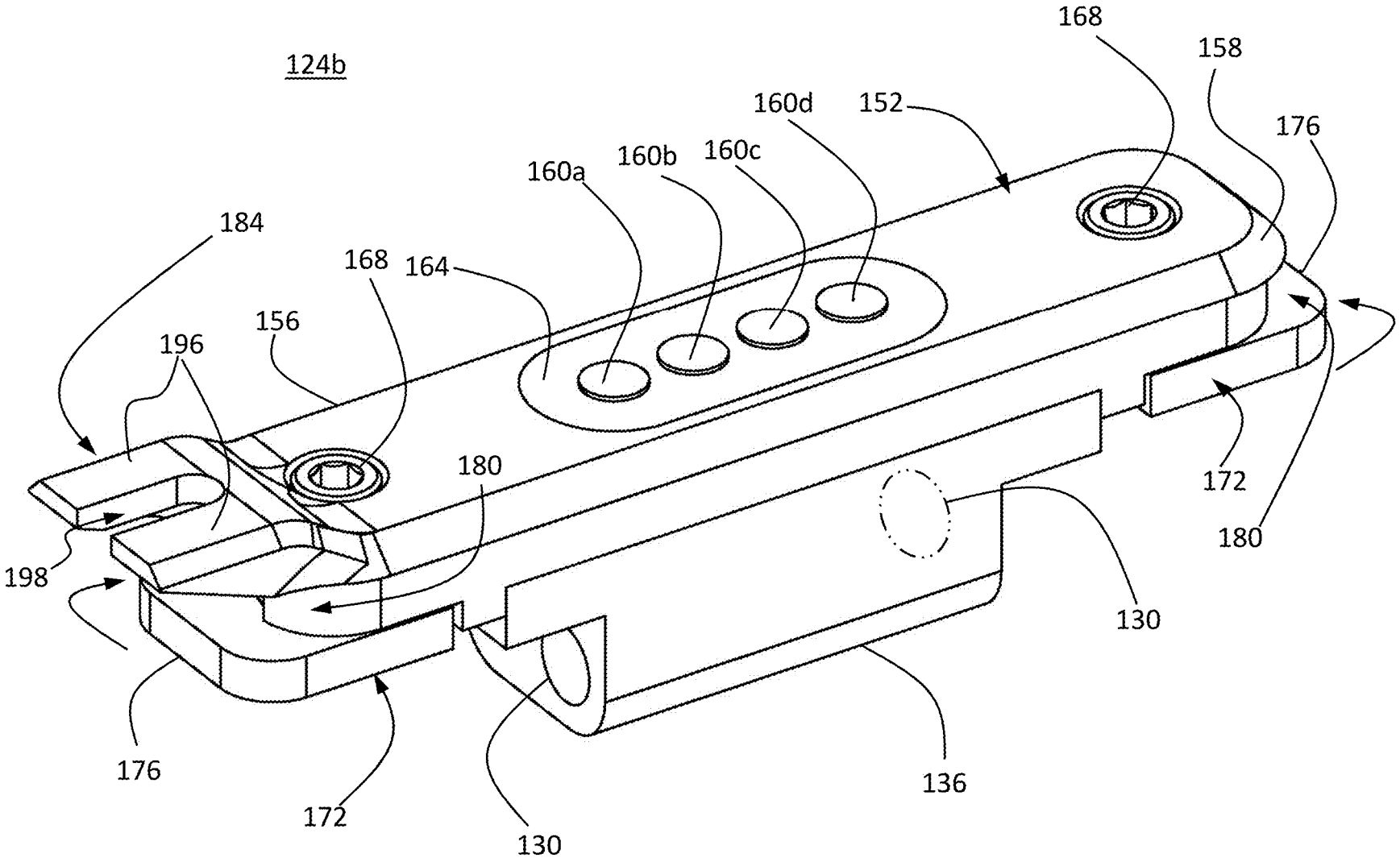
FIG. 8 is an enlarged isometric view of an insert according to a second exemplary embodiment.

Referring now to FIG. 8, there is shown an alternative insert 124*b*' which as described above with respect to the insert 124*a* appearing in FIG. 7, except that the housing 152 further includes an accessory retention hook or latch 184, the function of which will be described in greater detail below.

Figure 10:
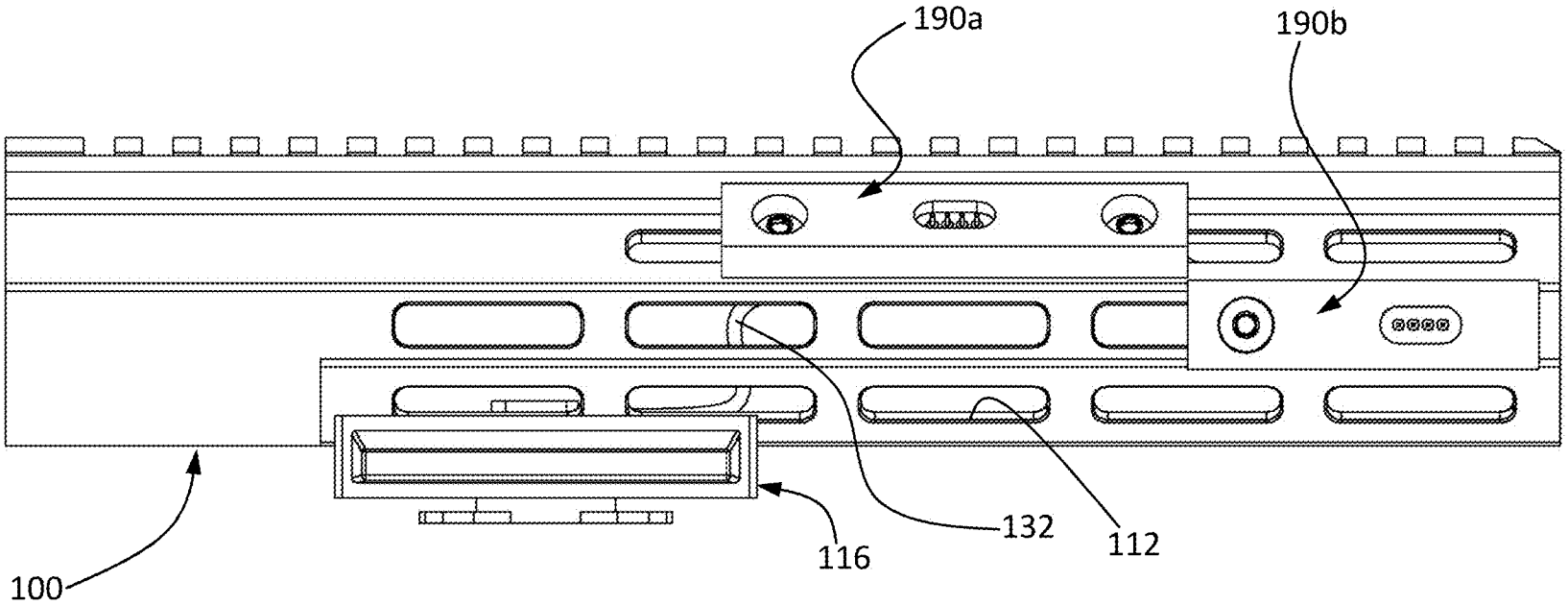
FIG. 10 is a side view of the embodiment appearing in FIG. 1 with two example accessories mounted to the inserts.

Referring now to FIG. 10, there is shown a handguard 100 having a first accessory 190*a* which can be attached to the insert 124*a* and a second accessory 190*b* which can be attached to the insert 124*b*'.

Figure 11:
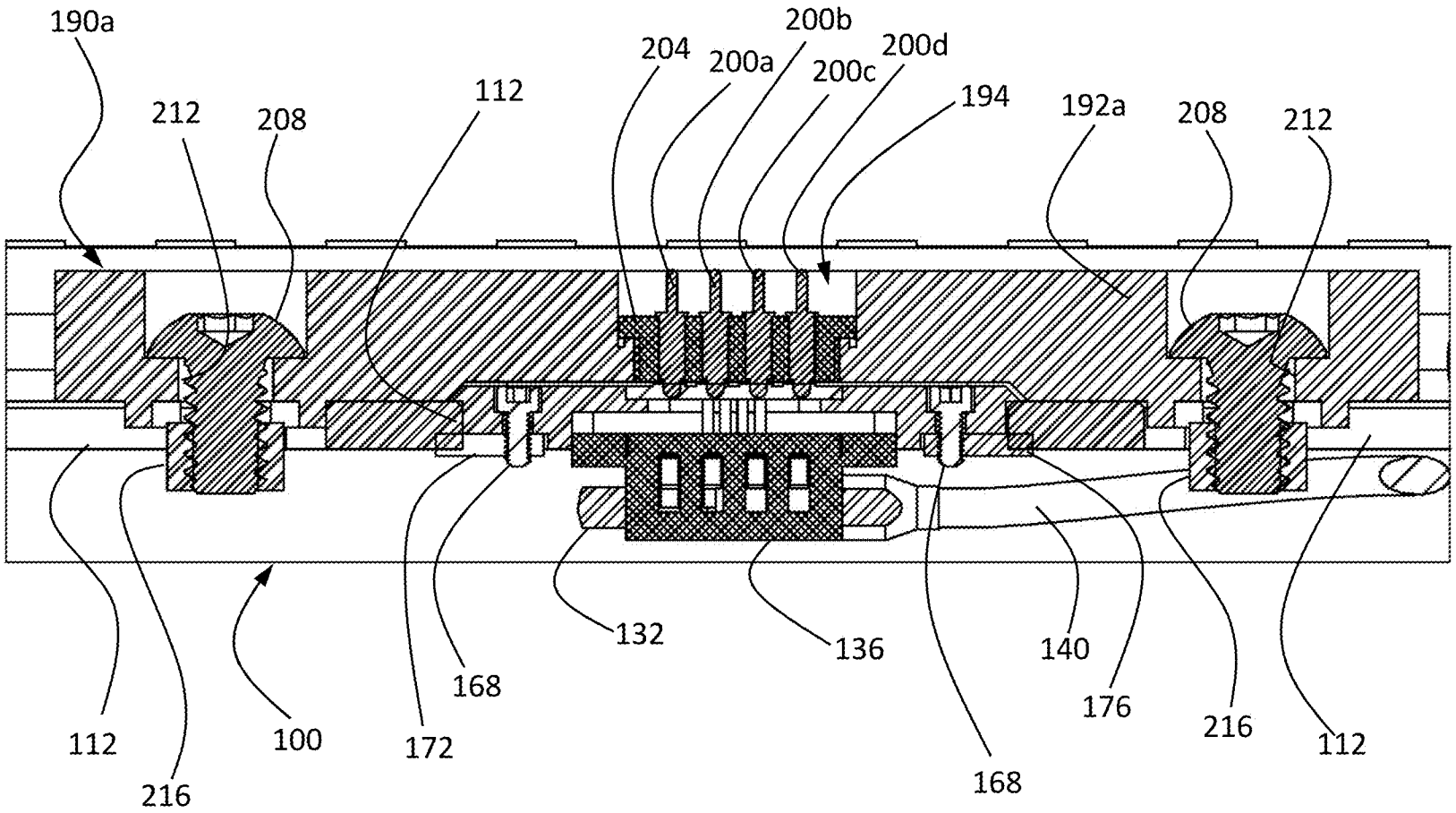
FIG. 11 is a side cross sectional view of a first example accessory which, in turn, is electrically coupled to an insert attached to a slot of a slot rail system.

Referring now to FIG. 11, there appears a cross-sectional view showing the accessory 190*a* which has a housing 192*a*. An electrical connector 194 is formed in the housing 192*a* and includes an insulator 204 and electrical contacts 200*a*-200*d*, which engage the respective contacts 160*a*-160*d* on the insert 124*a*. In embodiments, the electrical contacts 200*a*-200*d* are contact pins, such as spring loaded or pogo pins.

The accessory 190*a* is secured over the insert 124*a* utilizing the adjacent slot 112 on either side of the insert 124*a*. Threaded fasteners 208 pass through apertures 212 in the housing 192*a* and engage slot rail (e.g., M-LOK) retention clips 216, which may be conventional T-nuts utilized in connection with M-LOK rail interface slots. The T-nuts 216 include elongated tabs or flanges 218 (see FIG. 18) which are rotatable with the screw 208 as understood by persons skilled in the art. In operation, the T-nuts 216 are rotated so that the long axis of the tabs are parallel to the long axis of the slots 112. The screws 208 are then rotated to cause the T-nuts 216 to rotate until the long axis of the tabs are perpendicular to the long axis of the slots 112 to secure the accessory 190*a* in place. In embodiments, the shaft portion of the T-nuts 216 are provided with rounded corners and nonrounded corners to constrain rotation of the T-nuts 216 between the parallel and perpendicular positions in relation to the slots 112.

Figure 12:
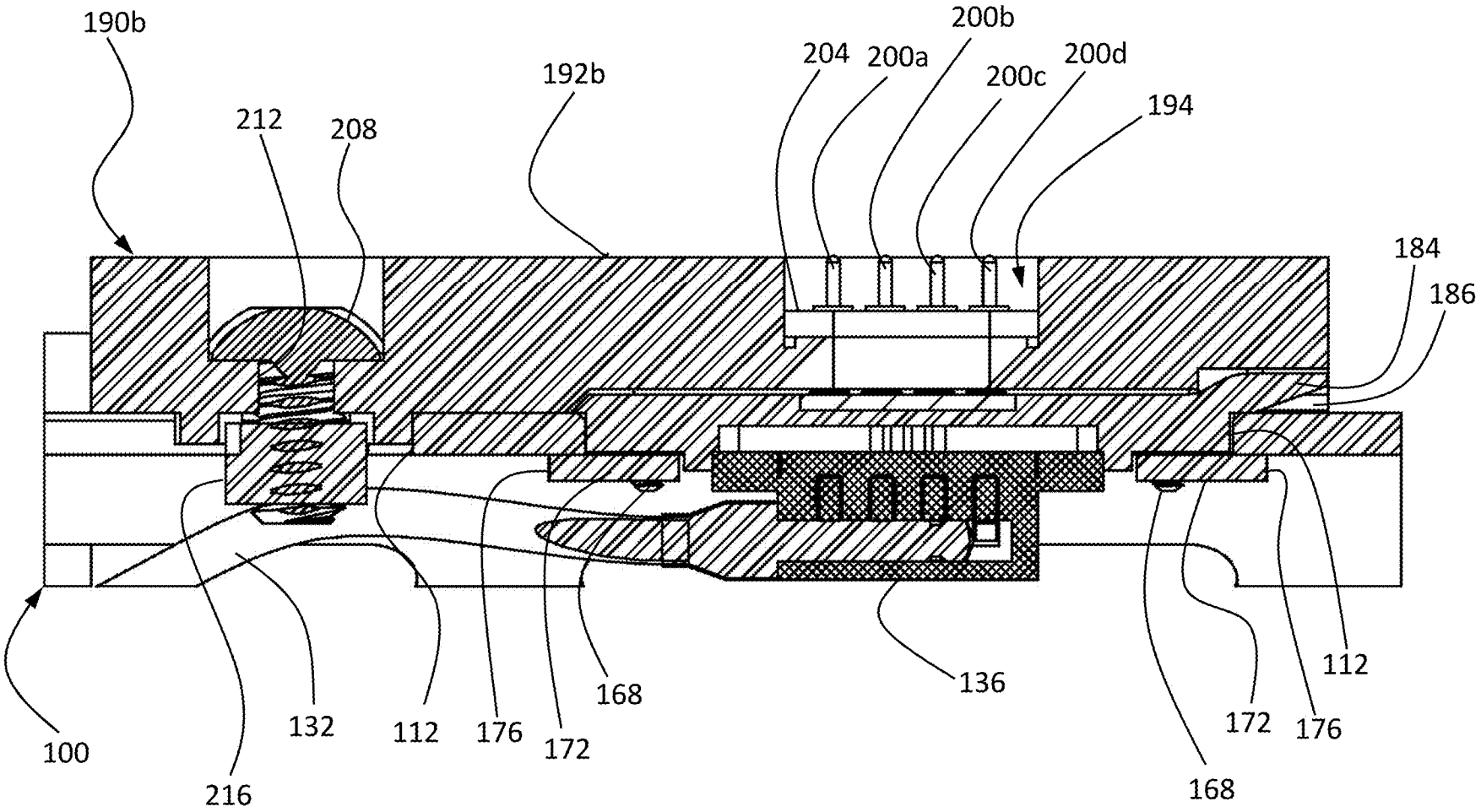
FIG. 12 is a side cross sectional view of a second example accessory which, in turn, is electrically coupled to an insert attached to a slot of a slot rail.
Figure 13:
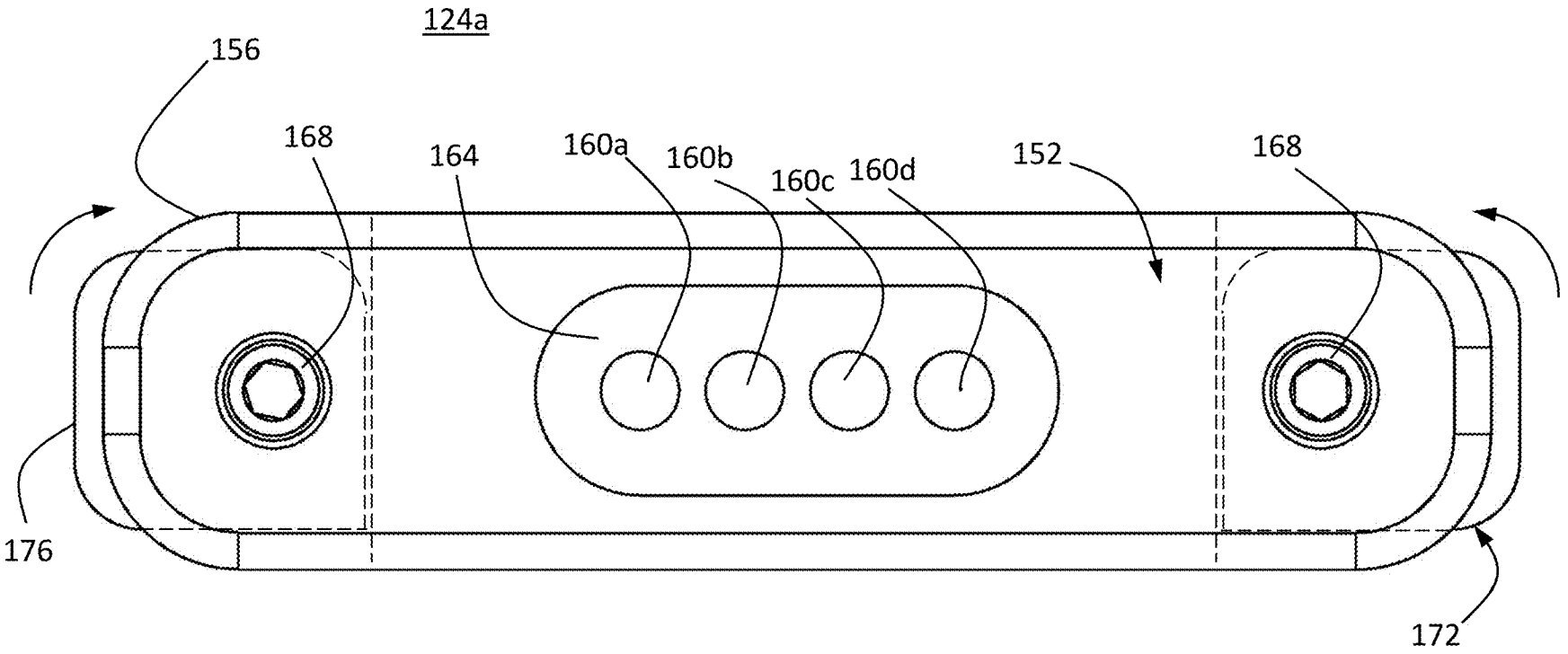
FIG. 13 is a top view of an example insert.
Figure 14:
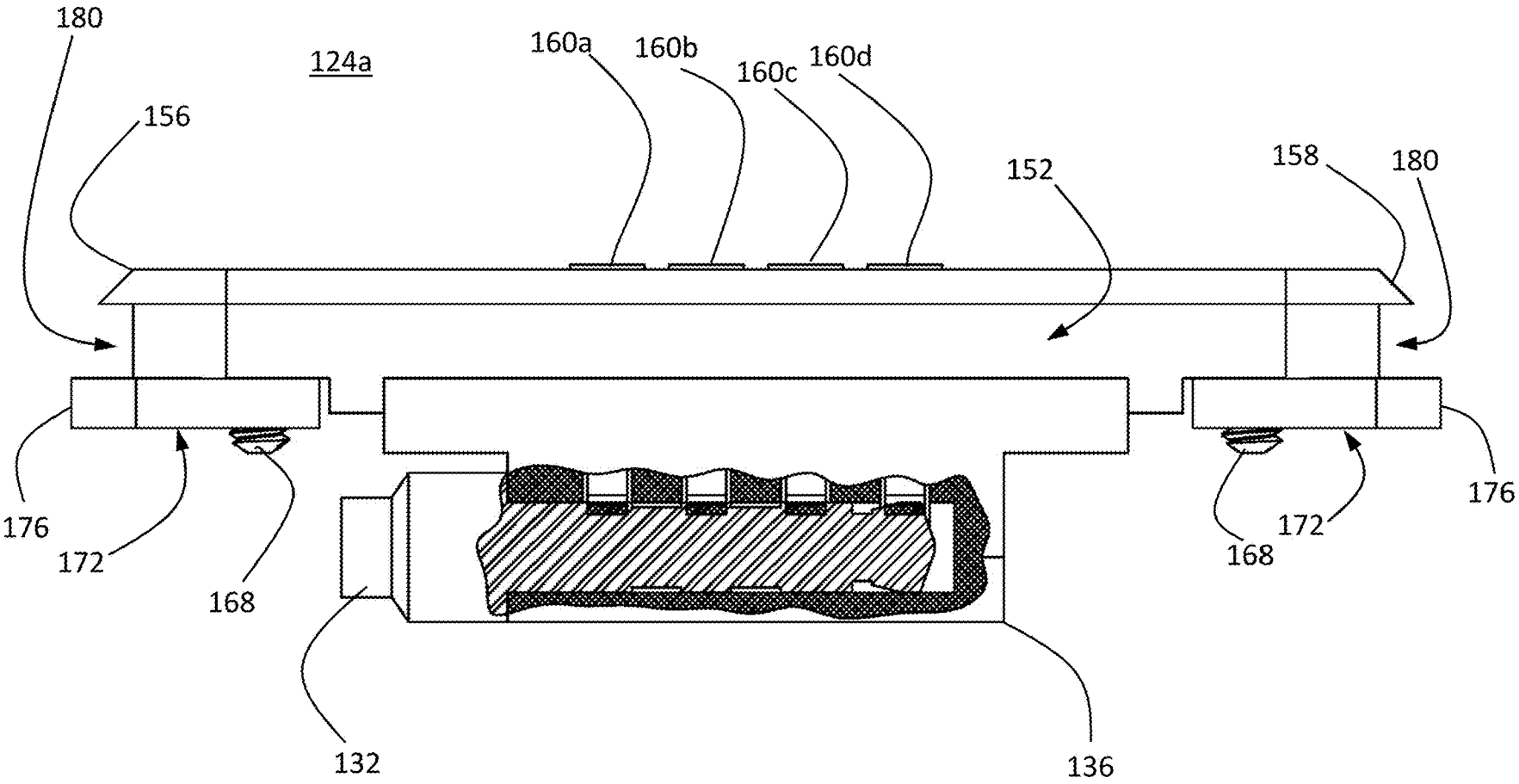
FIG. 14 is a side partial cross sectional view of the insert appearing in FIG. 13.
Figure 15:
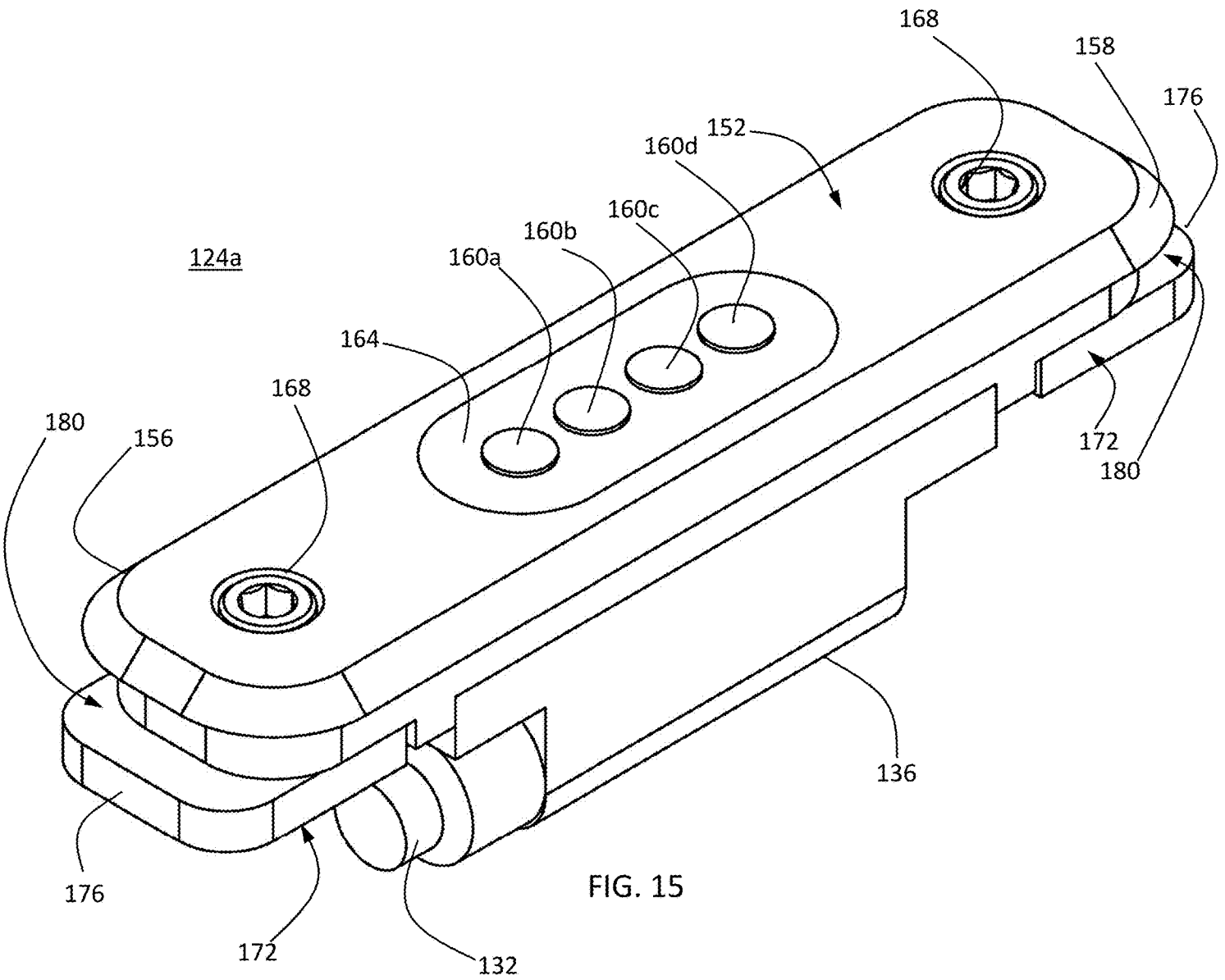
FIG. 15 is an isometric view of the insert appearing in FIG. 13.

Referring now to FIG. 12, there appears a cross-sectional view showing the accessory 190*b* which has a housing 192*b*. An electrical connector 194 is formed in the housing 192*b* and includes an insulator block 204 and electrical contacts 200*a*-200*d*, which engage the respective contacts 160*a*-160*d* on the insert 124*b*'. In embodiments, the electrical contacts 200*a*-200*d* are contact pins, such as spring loaded or pogo pins.

The accessory 190*b* is secured over the insert 124*b*' utilizing an adjacent slot 112 one side of the insert 124*b*' and the accessory retention hook or latch 184 disposed on the accessory housing 152 at the opposite side of the insert 124*b*'. Thus, whereas the accessory 190*a* and the associated insert 124*a* shown in FIG. 11 occupy three slots 112 on the handguard 100, the accessory 190*b* and insert 124*b*' only occupy two slots 112 on the handguard 100.

In embodiments, the accessory retention hook or latch 184 includes two prongs 196 defining a notch 198 between them. The accessory retention hook or latch 184 engages a complementary catch or receptacle 186 disposed on one end of the accessory housing 192*b*. At the other end of the housing 192*b*, a threaded fastener 208 passes through an aperture 212 in the housing 192*b* and engages a slot rail T-nut 216. The T-nut 216 includes elongated tabs or flanges which are rotatable with the screw 208 as understood by persons skilled in the art. In operation, the T-nut 216 is rotated so that the long axis of the tabs are parallel to the long axis of the slots 112. The screw 208 is then rotated to cause the T-nut 216 to rotate until the long axis of the tabs are perpendicular to the long axis of the slot 112 to secure the accessory 190*b* in place. In embodiments, the shaft portion of the T-nuts 216 are provided with rounded corners and nonrounded corners to constrain rotation of the T-nut 216 between the parallel and perpendicular positions in relation to the slot 112.

Figure 16:
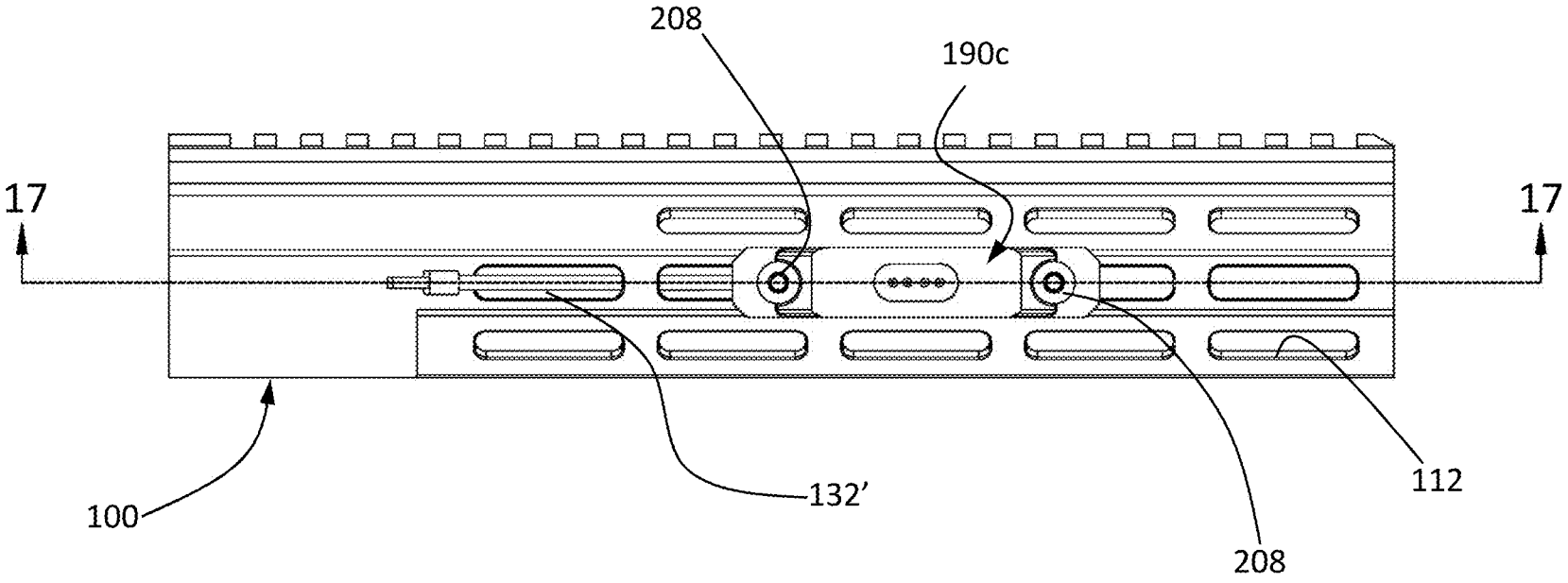
FIG. 16 is a side view of a handguard having an alternative embodiment accessory mount which has an integral connector and is the handguard thereto without the need for an insert.
Figure 17:
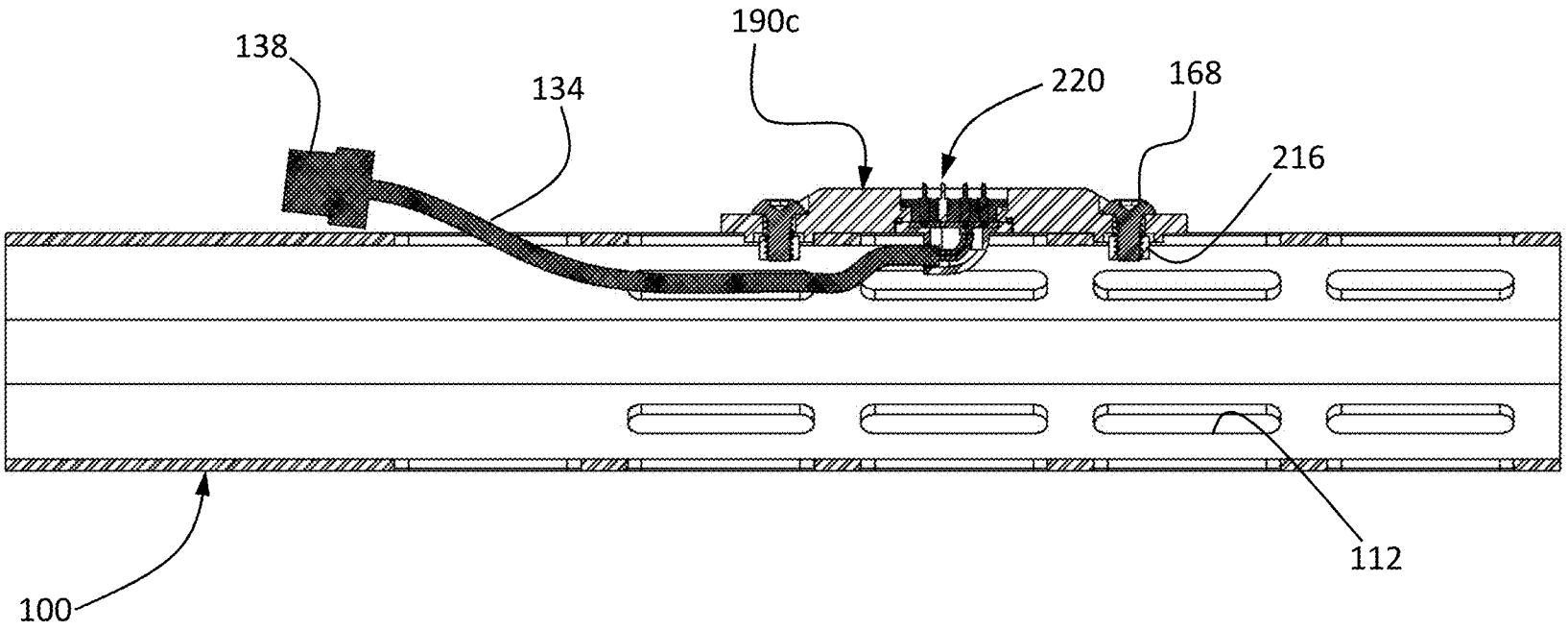
FIG. 17 is a cross sectional view taken along the lines 17-17 appearing in FIG. 16.
Figure 18:
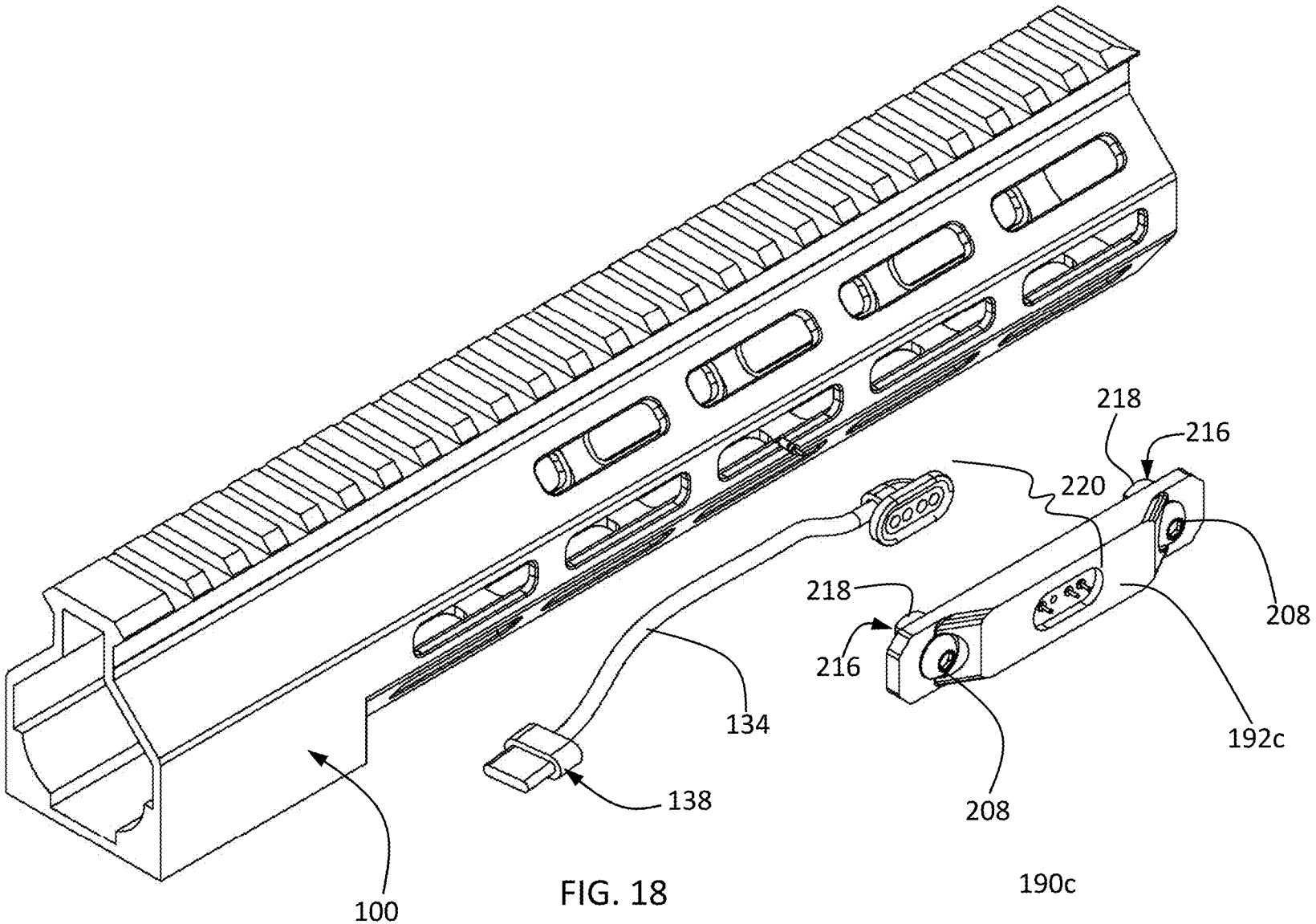
FIG. 18 is an exploded, isometric view of the handguard and accessory appearing in FIG. 16.

Referring now to FIGS. 16-18, there is shown an accessory device 190*c* in accordance with a third embodiment, which can serve as an alternative data and power port which does not require the use of an insert 124*a*-124*n*. The accessory device 190*c* includes a housing 192*c* and an electrical connector 220 having GND, D+, D−, and VCC pins or terminals as described above. The connector 220 is electrically coupled to a cable 134 having a connector end 138, which is configured for connection to control module, such as the control module 116, or other computer-based processing system. The cable 134 can be routed under the handguard 110 as needed. The housing 192*c* includes openings receiving threaded fasteners 168 which engage rotatable retention clips 216, which may be, e.g., a conventional M-LOK T-nut. In the illustrated embodiment, the housing 192*c* is positioned over a central slot and the rotatable retention clips 216 each engage an adjacent slot on opposing side of the central slot, wherein the cable 134 passes into the interior space defines by the handguard through central slot.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A system for connecting a weapon-mounted accessory to a computer, comprising:

a first data and power port configured to operably connect to the computer, the first data and power port being capable of providing data and power transmission between the computer and the weapon-mounted accessory;

wherein the first data and power port is configured to detachably couple to a slot defining a through opening in a slot rail weapon interface.

2. The system of claim 1, further comprising:

said first data and power port including a housing having a peripheral flange disposed on an exterior facing side of the first data and power port and at least one rotating tab which cooperates with the peripheral flange to define a channel therebetween;

said at least one rotating tab rotatable between a first position wherein the at least one rotating tab extends generally perpendicular to the longitudinal axis of the slot and is configured to permit insertion and removal of the first data and power port with respect to the slot and a second position wherein the at least one rotating tab extends generally parallel to the longitudinal axis of the slot and is configured to secure a rim of the slot within the channel to retain the first data and power port within the slot.

3. The system of claim 2, wherein the housing further includes an integral latch for detachably engaging a complementary catch latch disposed on the weapon-mounted accessory.

4. The system of claim 1, further comprising:

said first data and power port including a housing having a peripheral flange disposed on an exterior facing side of the first data and power port and a pair of axially spaced apart rotating tabs, each of the rotating tabs cooperating with the peripheral flange to define a channel therebetween;

each of the rotating tabs rotatable between a first position wherein the rotating tabs extend generally perpendicular to the longitudinal axis of the slot and are configured to permit insertion and removal of the first data and power port with respect to the slot and a second position wherein the tabs extend generally parallel to the longitudinal axis of the slot and are configured to secure a rim of the slot within the channel to retain the first data and power port within the slot.

5. The system of claim 1, further comprising:

one or more additional data and power ports, each additional data and power port being capable of providing data and power transmission between the computer and one or more additional weapon-mounted accessories;

wherein each of the one or more additional data and power ports is configured to detachably couple to a like slot defining a through opening in the slot rail weapon interface;

wherein the first data and power port and the one or more additional data and power ports are configured to be operably connected to each other to form a serial chain in a custom configuration of data and power ports; and wherein the custom configuration of data and power ports enables simultaneous data and power transmission between the computer, the accessory connected to the first data and power port, and each of the one or more additional accessories connected to the one or more additional data and power ports.

6. The system of claim 1, in combination with the computer.

7. The system of claim 6, wherein the computer is configured to detachably couple to a like slot defining a through opening in the slot rail weapon interface.

8. The system of claim 7, wherein the computer includes a battery pack interface for detachably and operatively coupling a battery pack to the computer, wherein the computer is configured to electrically couple the battery pack to the first data and power port when the battery pack coupled to the battery pack interface.

9. The system of claim 8, in combination with the battery pack.

10. The system of claim 8, wherein the battery pack interface is a Small Tactical Universal Battery (STUB) interface.

11. The system of claim 1, further comprising a weapon handguard configured to surround a barrel of a weapon, wherein the slot rail weapon interface is disposed on the handguard.

12. The system of claim 11, further comprising a cable for electrically coupling the first data and power port to the computer, wherein at least a portion of the cable is configured to pass within an interior space defined by the handguard.

13. The system of claim 1, the first data and power port including:

a housing configured to be positioned over the slot defining a through opening in the slot rail weapon interface;

a first retention clip coupled to the housing and configured to detachably engage with a first like slot adjacent the slot;

a second retention clip coupled to the housing and configured to detachably engage with a second like slot defining a through opening which is adjacent the slot defining a through opening and opposite the first like adjacent slot defining a through opening; and an electrical power and data cable configured to pass through the slot defining a through opening.

* * * * *